US010621937B2

(12) United States Patent
Nakanishi et al.

(10) Patent No.: US 10,621,937 B2
(45) Date of Patent: Apr. 14, 2020

(54) LIQUID CRYSTAL DISPLAY DEVICE AND METHOD OF DRIVING THE SAME

(71) Applicant: Panasonic Liquid Crystal Display Co., Ltd., Himeji-shi, Hyogo (JP)

(72) Inventors: Hideyuki Nakanishi, Hyogo (JP); Yoshihisa Ooishi, Kanagawa (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 33 days.

(21) Appl. No.: 15/983,447

(22) Filed: May 18, 2018

(65) Prior Publication Data

US 2018/0268770 A1 Sep. 20, 2018

Related U.S. Application Data

(63) Continuation of application No. PCT/JP2015/005780, filed on Nov. 18, 2015.

(51) Int. Cl.
*G09G 3/36* (2006.01)

(52) U.S. Cl.
CPC ..... *G09G 3/3677* (2013.01); *G09G 3/3648* (2013.01); *G09G 3/3614* (2013.01); *G09G 2310/0213* (2013.01); *G09G 2310/0278* (2013.01); *G09G 2310/062* (2013.01); *G09G 2320/0204* (2013.01); *G09G 2320/0271* (2013.01); *G09G 2330/021* (2013.01)

(58) Field of Classification Search
CPC ..... G09G 3/3677; G09G 3/3648; G09G 2310/0278; G09G 2310/062; G09G 2320/0204; G09G 2330/021
See application file for complete search history.

(56) References Cited

U.S. PATENT DOCUMENTS

2006/0022305 A1* 2/2006 Yamashita ..... G09G 3/2014 257/565
2010/0002021 A1* 1/2010 Hashimoto ..... G09G 3/2003 345/690
2010/0315402 A1* 12/2010 Hashimoto ..... G09G 3/3614 345/211
2011/0025589 A1 2/2011 Ooishi
(Continued)

FOREIGN PATENT DOCUMENTS

JP 2002-244623 8/2002
JP 2011-033889 2/2011
(Continued)

*Primary Examiner* — Towfiq Elahi
(74) *Attorney, Agent, or Firm* — Hamre, Schumann, Mueller & Larson, P.C.

(57) ABSTRACT

A display device includes data lines extending in a first direction, gate lines extending in a second direction, a source driver that supplies a data signal to the data lines, a gate driver that supplies a gate signal to the gate lines, and a timing controller that determines scan order of the gate lines and outputs image data to the source driver based on the scan order. The timing controller determines the scan order of the gate lines based on an input image corresponding to input image data input from an outside, and switches first scan order and second scan order in each frame, the first scan order and the second scan order being different from each other in the scan order.

5 Claims, 19 Drawing Sheets

(56) References Cited

U.S. PATENT DOCUMENTS

| | | | | |
|---|---|---|---|---|
| 2014/0320478 | A1* | 10/2014 | Oh | G09G 3/00 345/212 |
| 2014/0375622 | A1* | 12/2014 | Nakagawa | G09G 3/3614 345/212 |
| 2015/0070343 | A1* | 3/2015 | Lee | G09G 3/20 345/212 |
| 2015/0116303 | A1 | 4/2015 | Lee et al. | |
| 2015/0145842 | A1* | 5/2015 | Maeda | G09G 3/3233 345/208 |
| 2016/0035302 | A1* | 2/2016 | Sun | G09G 3/3648 345/209 |
| 2016/0267868 | A1* | 9/2016 | Choi | G09G 3/3677 |
| 2016/0299399 | A1* | 10/2016 | Kitani | G02F 1/136286 |
| 2016/0358531 | A1 | 12/2016 | Nakakita et al. | |

FOREIGN PATENT DOCUMENTS

| | | |
|---|---|---|
| JP | 2013-109198 | 6/2013 |
| JP | 5378613 B | 10/2013 |
| WO | 2013/118323 | 8/2013 |
| WO | 2014/010313 | 1/2014 |
| WO | 2015/104777 | 7/2015 |

* cited by examiner

FIG.4A

| | | | | | |
|---|---|---|---|---|---|
| VIRTUAL line0 | 0 | 0 | 0 | 0 | |
| line1 | 12 | 250 | 9 | 248 | UNIT OF FOUR LINES |
| line2 | 243 | 14 | 252 | 15 | |
| line3 | 18 | 238 | 20 | 242 | |
| line4 | 250 | 13 | 250 | 21 | |
| line5 | 5 | 255 | 14 | 254 | UNIT OF FOUR LINES |
| line6 | 159 | 148 | 136 | 180 | |
| line7 | 128 | 180 | 108 | 202 | |
| line8 | 138 | 208 | 89 | 178 | |
| | | | | | |

FIRST FRAME : INPUT IMAGE DATA Data

FIG.4B

| | | | |
|---|---|---|---|
| + | − | + | − |
| + | − | + | − |
| + | − | + | − |
| + | − | + | − |
| + | − | + | − |
| + | − | + | − |
| + | − | + | − |
| + | − | + | − |

DATA POLARITY (COLUMN INVERSION)

FIG.7

| | | | | | |
|---|---|---|---|---|---|
| VIRTUAL line0 | 256 | 256 | 256 | 256 | |
| line1 | 303 | 14 | 297 | 16 | UNIT OF FOUR LINES |
| line2 | 490 | 206 | 501 | 204 | |
| line3 | 313 | 28 | 316 | 24 | |
| line4 | 499 | 208 | 499 | 195 | |
| line5 | 289 | 7 | 306 | 9 | UNIT OF FOUR LINES |
| line6 | 417 | 102 | 404 | 79 | |
| line7 | 400 | 79 | 390 | 63 | |
| line8 | 405 | 58 | 380 | 81 | |
| | | | | | |

FIRST FRAME: DATA AFTER VOLTAGE LEVEL IS CONVERTED

FIG.8A

BEFORE SWITCHING OF SCAN ORDER

| | | | | | DIFFERENCE IN VOLTAGE BETWEEN LINES |
|---|---|---|---|---|---|
| VIRTUAL line0 | 256 | 256 | 256 | 256 | |
| line1 | 303 | 14 | 297 | 16 | 570 |
| line2 | 490 | 206 | 501 | 204 | 771 |
| line3 | 313 | 28 | 316 | 24 | 720 |
| line4 | 499 | 208 | 499 | 195 | 720 |

SUM OF VOLTAGE DIFFERENCES IN FOUR LINES = 2781

FIG.8B

AFTER SWITCHING OF SCAN ORDER

| | | | | | DIFFERENCE IN VOLTAGE BETWEEN LINES |
|---|---|---|---|---|---|
| VIRTUAL line0 | 256 | 256 | 256 | 256 | |
| line1 | 303 | 14 | 297 | 16 | 570 |
| line3 | 313 | 28 | 316 | 24 | 51 |
| line2 | 490 | 206 | 501 | 204 | 720 |
| line4 | 499 | 208 | 499 | 195 | 22 |

SUM OF VOLTAGE DIFFERENCES IN FOUR LINES = 1363

FIG.9

| | | | | | |
|---|---|---|---|---|---|
| VIRTUAL line0 | 512 | 0 | 512 | 0 | |
| line1 | 303 | 14 | 297 | 16 | UNIT OF FOUR LINES |
| line2 | 490 | 206 | 501 | 204 | |
| line3 | 313 | 28 | 316 | 24 | |
| line4 | 499 | 208 | 499 | 195 | |
| line5 | 289 | 7 | 306 | 9 | UNIT OF FOUR LINES |
| line6 | 417 | 102 | 404 | 79 | |
| line7 | 400 | 79 | 390 | 63 | |
| line8 | 405 | 58 | 380 | 81 | |
| | | | | | |

FIVE FRAME: DATA AFTER VOLTAGE LEVEL IS CONVERTED

FIG.10A

BEFORE SWITCHING OF SCAN ORDER

| | | | | | DIFFERENCE IN VOLTAGE BETWEEN LINES |
|---|---|---|---|---|---|
| VIRTUAL line0 | 512 | 0 | 512 | 0 | |
| line1 | 303 | 14 | 297 | 16 | 570 |
| line2 | 490 | 206 | 501 | 204 | 771 |
| line3 | 313 | 28 | 316 | 24 | 720 |
| line4 | 499 | 208 | 499 | 195 | 720 |

SUM OF VOLTAGE DIFFERENCES IN FOUR LINES = 2781

FIG.10B

AFTER SWITCHING OF SCAN ORDER

| | | | | | DIFFERENCE IN VOLTAGE BETWEEN LINES |
|---|---|---|---|---|---|
| VIRTUAL line0 | 512 | 0 | 512 | 0 | |
| line4 | 499 | 208 | 499 | 195 | 429 |
| line2 | 490 | 206 | 501 | 204 | 22 |
| line3 | 313 | 28 | 316 | 24 | 720 |
| line1 | 303 | 14 | 297 | 16 | 51 |

SUM OF VOLTAGE DIFFERENCES IN FOUR LINES = 1222

FIG.14A

| | | | | | |
|---|---|---|---|---|---|
| VIRTUAL line0 | 256 | 256 | 256 | 256 | |
| line1 | 303 | 14 | 297 | 16 | UNIT OF FOUR LINES |
| line2 | 22 | 306 | 11 | 308 | |
| line3 | 313 | 28 | 316 | 24 | |
| line4 | 14 | 304 | 14 | 317 | |
| line5 | 289 | 7 | 306 | 9 | UNIT OF FOUR LINES |
| line6 | 95 | 411 | 108 | 433 | |
| line7 | 400 | 79 | 390 | 63 | |
| line8 | 107 | 454 | 132 | 432 | |
| | | | | | |

FIRST FRAME: DATA AFTER VOLTAGE LEVEL IS CONVERTED

FIG.14B

| | | | |
|---|---|---|---|
| + | − | + | − |
| − | + | − | + |
| + | − | + | − |
| − | + | − | + |
| + | − | + | − |
| − | + | − | + |
| + | − | + | − |
| − | + | − | + |

DATA POLARITY (DOT INVERSION)

FIG.16

| | | | | | |
|---|---|---|---|---|---|
| VIRTUAL line0 | 256 | 256 | 256 | 256 | |
| line1 | 303 | 14 | 297 | 16 | UNIT OF FOUR LINES |
| line2 | 490 | 206 | 501 | 204 | |
| line3 | 313 | 28 | 316 | 24 | |
| line4 | 499 | 208 | 499 | 195 | |
| line5 | 289 | 7 | 306 | 9 | UNIT OF FOUR LINES |
| line6 | 417 | 102 | 404 | 79 | |
| line7 | 400 | 79 | 390 | 63 | |
| line8 | 405 | 58 | 380 | 81 | |
| | | | | | |

FIRST FRAME: DATA AFTER VOLTAGE LEVEL IS CONVERTED

DIFFERENCE IN VOLTAGE LEVEL BETWEEN TWO LINES

A=Line1−Line0= 570
B=Line2−Line1= 771
C=Line2−Line0= 581
D=Line3−Line1= 51
E=Line3−Line2= 720
F=Line3−Line0= 577
G=Line4−Line1= 771
H=Line4−Line2= 22
I=Line4−Line3= 720
J=Line4−Line0= 595

LIQUID CRYSTAL DISPLAY DEVICE AND METHOD OF DRIVING THE SAME

CROSS-REFERENCE TO RELATED APPLICATION

This application is a bypass continuation of international patent application PCT/JP2015/005780, filed on Nov. 18, 2015 designating the United States of America. The entire disclosure of the international patent application is incorporated herein by reference in this entirety.

TECHNICAL FIELD

The present invention relates to a liquid crystal display device and a method of driving the liquid crystal display device.

BACKGROUND

In the display device, a technique for determining a selection order (scan order) of gate lines based on an input image is conventionally proposed in order to achieve low power consumption and downsizing of a power supply circuit. For example, in a technique disclosed in a prior art (for example, see Japanese Patent No. 5,378,613), the scan order of gate lines is determined based on an input image such that a plurality of source lines are driven by drive power smaller than drive power of a plurality of source lines required when a plurality of gate lines are selected in arrangement order.

However, a problem of so-called DC burning arises in the conventional technique. FIGS. 18A-18H are schematic diagrams illustrating a generation principle of the DC burning. FIGS. 18A-18D illustrate pieces of input image data of first to fourth frames, and FIGS. 18E to 18H illustrate the scan order of each of the first to fourth frames. At this point, it is assumed that a display panel is constructed with eight lines. It is also assumed that each frame image is constructed with a white image (255 gradations), a gray image (128 gradations), and a black image (0 gradation). FIG. 19 is a timing chart illustrating gate signal G1 supplied to first gate line GL1 and a source voltage supplied to a pixel of a first line (Line 1). When the first to eighth lines are selected in the scan order as illustrated in FIGS. 18E to 1811, as illustrated in the timing chart of FIG. 19, an average value of source voltages is shifted from a common voltage, and a DC component remains. Consequently, the burning occurs on a display screen.

SUMMARY

An object of the present disclosure, which has been made of light of the above problem, is to reduce the burning on a display screen in a display device that determines the scan order of gate lines based on an input image.

In one general aspect, the instant application describes a display device which includes data lines extending in a first direction, gate lines extending in a second direction, a source driver that supplies a data signal to the data lines, a gate driver that supplies a gate signal to the gate lines, and a timing controller that determines scan order of the gate lines and outputs image data to the source driver based on the scan order. The timing controller determines the scan order of the gate lines based on an input image corresponding to input image data input from an outside, and switches first scan order and second scan order in each frame, the first scan order and the second scan order being different from each other in the scan order.

The above general aspect may include one or more of the following features. The first scan order may be ascending order of a gradation of the input image data, and the second scan order may be descending order of the gradation of the input image data.

The timing controller determines the scan order in units of N lines (N is an integer of 2 or more). In first line data corresponding to a preceding-stage line and a plurality of second line data corresponding to a plurality of lines included in the N lines in the input image data, the timing controller may determine the scan order based on a voltage level difference between pixels corresponding to the identical data line in each of the first line data and the second line data.

When the first scan order is determined, first virtual line data in which a voltage level of each pixel is set to a voltage level of halftone may be used as the first line data in determining a line to be scanned first out of first N lines in each frame, and when the second scan order is determined, second virtual line data in which the voltage level of each pixel may be set to a voltage level of a low gradation or a high gradation in determining the line to be scanned first out of the first N lines in each frame.

The timing controller may determine a line having a minimum sum of voltage level differences in the plurality of lines as a line to be scanned next.

The timing controller may include a plurality of line memories that store the input image data for each line. The timing controller may sequentially read the input image data from the plurality of line memories according to the scan order, and outputs the input image data to the source driver.

In another general aspect, a method for driving a display device including: a plurality of data lines extending in a first direction; a plurality of gate lines extending in a second direction; a source driver that supplies a data signal to the plurality of data lines; a gate driver that supplies a gate signal to the plurality of gate lines; and a timing controller that determines scan order of the plurality of gate lines and outputs image data to the source driver based on the scan order. The method includes determining the scan order of the plurality of gate lines based on an input image corresponding to input image data input from an outside; and scanning the plurality of gate lines by switching first scan order and second scan order in each plurality of frames, the first scan order and the second scan order being different from each other in the scan order.

According to the display device of the present disclosure and the method for driving the display device, the burning on the display screen can be reduced in the display device that determines the scan order of the gate lines based on the input image.

BRIEF DESCRIPTION OF THE DRAWINGS

FIG. 4A illustrates input image data;

FIG. 4B illustrates a data polarity corresponding to a column inversion drive;

FIG. 7 illustrates the input image data converted from the voltage level in one frame;

FIG. 8A illustrates a sum of the voltage level differences before a scan order is switched;

FIG. 8B illustrates a sum of the voltage level differences before the scan order (first scan order) is switched;

FIG. 9 illustrates the input image data converted from the voltage level in fifth frame;

FIG. 10A illustrates a sum of the voltage level differences before a scan order is switched;

FIG. 10B illustrates a sum of the voltage level differences before the scan order (second scan order) is switched;

FIG. 14A illustrates input image data;

FIG. 14B illustrates a data polarity corresponding to a dot inversion drive;

FIG. 16 illustrates a calculation example of a voltage level difference between two lines for units of four lines;

DETAILED DESCRIPTION

An embodiment of the present application is described below with reference to the drawings. The embodiment of the present application takes a liquid crystal display device as an example of a display device of the present application. However, the present application is not limited thereto, but the display device may be another kind of display, such as an organic EL display.

Figure 1:
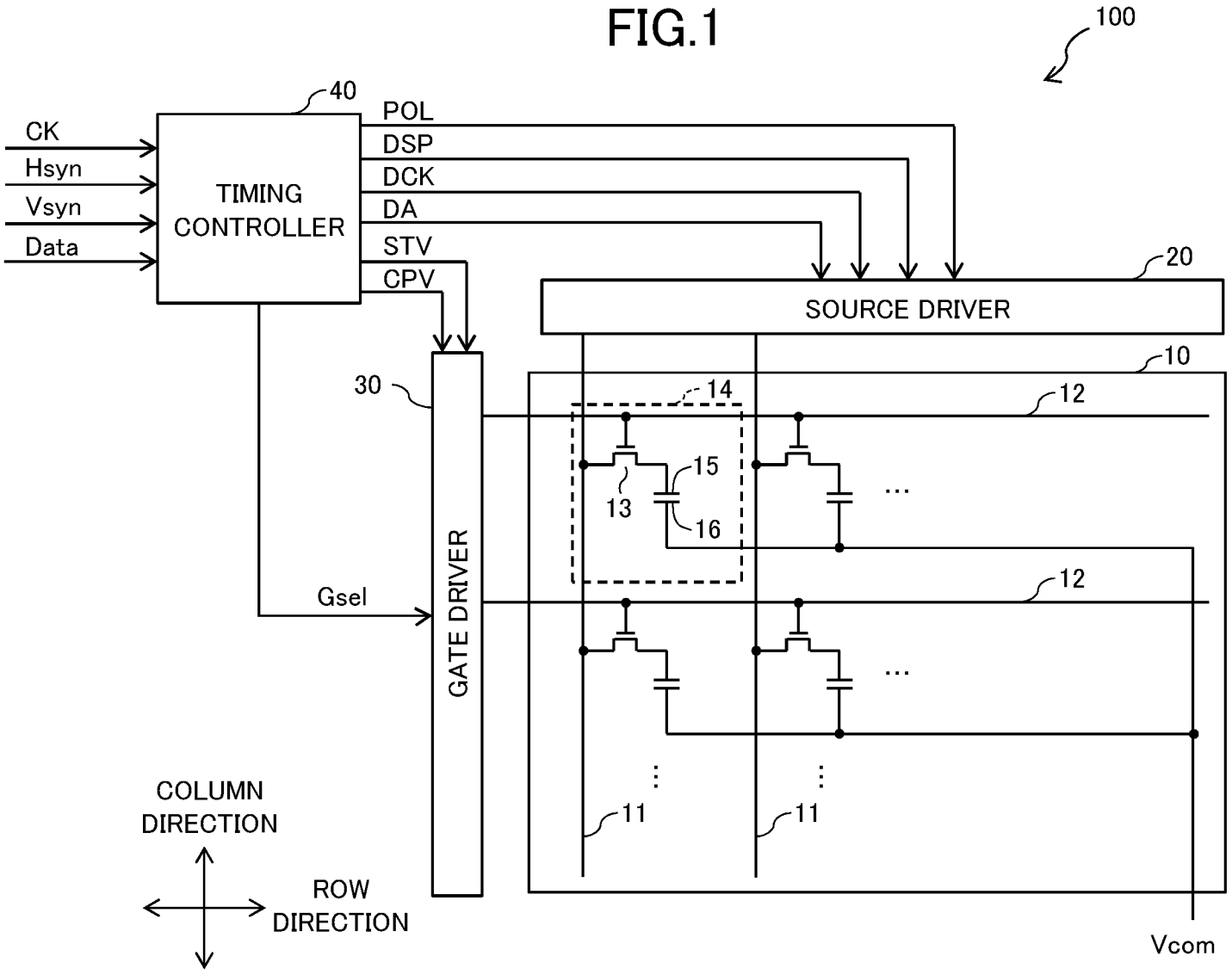
FIG. 1 is a plan view illustrating a schematic configuration of a liquid crystal display device according to an exemplary embodiment.

FIG. 1 is a plan view illustrating a schematic configuration of the liquid crystal display device according to the exemplary embodiment. Liquid crystal display device 100 includes display panel 10, source driver 20, gate driver 30, timing controller 40, and a backlight device (not illustrated).

A plurality of data lines 11 extending in a column direction and a plurality of gate lines 12 extending in a row direction are provided in display panel 10. Thin film transistor (TFT) 13 is provided in an intersection of each data line 11 and each gate line 12. Each data line 11 is connected to source driver 20, and each gate line 12 is connected to gate driver 30. In display panel 10, a plurality of pixels 14 are arranged into a matrix shape (the row direction and the column direction) corresponding to the intersections of data lines 11 and gate lines 12. Although not illustrated, display panel 10 includes a thin film transistor substrate (TFT substrate), a color filter substrate (CF substrate), and a liquid crystal layer sandwiched between the TFT substrate and the CF substrate. In the TFT substrate, a plurality of pixel electrodes 15 are provided corresponding to pixels 14. Common electrode 16 common to pixels 14 is provided in the CF substrate. Common electrode 16 may be provided in the TFT substrate.

A data signal (data voltage) is supplied from source driver 20 to each data line 11. A gate signal (gate voltage) is supplied from gate driver 30 to each gate line 12. Common voltage Vcom is supplied from a common driver (not illustrated) to common electrode 16. When a gate-on voltage is supplied to gate line 12, thin film transistor 13 connected to gate line 12 is turned on, and the data voltage is supplied to pixel electrode 15 through data line 11 connected to thin film transistor 13. An electric field is generated by a difference between the data voltage supplied to pixel electrode 15 and common voltage Vcom supplied to common electrode 16. Liquid crystal is driven by the electric field to control transmittance of light emitted from the backlight device, thereby displaying an image. For color display, a desired data voltage is supplied to data line 11 connected to pixel electrode 15 of pixel 14 corresponding to each of red, green, and blue, which are formed by a stripe color filter. To prevent display burning or the like, for example, a positive data voltage and a negative data voltage are alternately supplied to each data line 11.

Timing controller 40 generates output image data DA for image display and a plurality of control signals defining operation timing in source driver 20 and gate driver 30. Specifically, timing controller 40 generates the plurality of control signals including polarity control signal POL, data start pulse DSP, data clock DCK, gate start pulse STV, gate clock CPV, and gate select signal Gsel based on a timing signal (clock signal CK, vertical synchronizing signal Vsyn, and horizontal synchronizing signal Hsyn) supplied from an external system (not illustrated). Timing controller 40 supplies the plurality of generated control signals to source driver 20 and gate driver 30, and controls drive of source driver 20 and gate driver 30. Specifically, timing controller 40 supplies polarity control signal POL, data start pulse DSP, data clock DCK, and output image data DA to source driver 20. Timing controller 40 also supplies gate start pulse STV, gate clock CPV, and gate select signal Gsel to gate driver 30.

Polarity control signal POL is a control signal for determining the polarity of the data voltage supplied to data line 11. Polarity control signal POL is a signal switching between a high level and a low level in each frame (or each plurality of frames) or one line (or each plurality of lines). For example, when polarity control signal POL is at the low level, source driver 20 supplies voltage (positive data voltage) higher than common voltage Vcom to data line 11 based on output image data DA. On the other hand, when the polarity control signal POL is at the high level, source driver 20 supplies voltage (negative data voltage) lower than common voltage Vcom to data line 11 based on output image data DA. In this manner, source driver 20 supplies the data voltage corresponding to output image data DA to data line 11 while switching the polarity at a predetermined cycle. Consequently, liquid crystal display device 100 performs the image display by column inversion drive or dot inversion drive.

Figure 2:
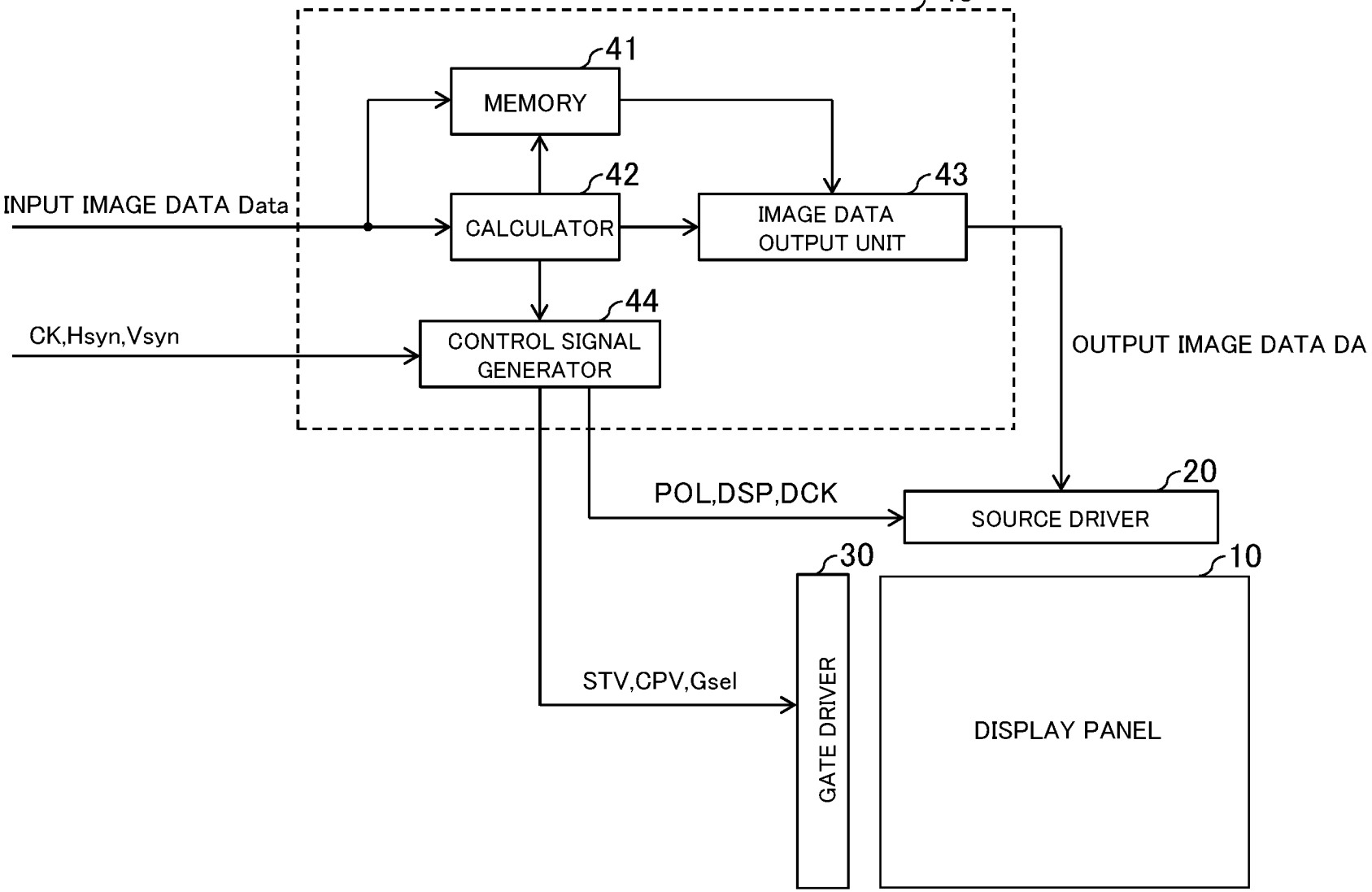
FIG. 2 is a block diagram illustrating a schematic configuration of timing controller according to the exemplary embodiment.

FIG. 2 is a block diagram illustrating a schematic configuration of timing controller 40. Timing controller 40 includes memory 41, calculator 42, image data output unit 43, and control signal generator 44. An image signal (input image data Data) supplied from the system is stored in memory 41 in units of one line or one frame. That is, memory 41 functions as a line memory or a frame memory. For example, memory 41 may include N line memories in which a plurality of lines (N lines) are stored.

Based on the voltage level of input image data Data supplied from the system, calculator 42 determines the readout order of the plurality of input image data Data stored in memory 41 and the scan order of the plurality of gate lines 12. For example, calculator 42 determines the readout order of the pieces of input image data Data of four lines stored in the four line memories and the scan order of four gate lines 12 that select the pixel lines corresponding to respective input image data Data.

Image data output unit 43 sequentially reads input image data Data from memory 41 according to a predetermined rule based on a calculation result of calculator 42, and outputs input image data Data to source driver 20. A specific method for reading input image data Data from memory 41 will be described later.

Based on the timing signal (clock signal CK, vertical synchronizing signal Vsyn, and horizontal synchronizing signal Hsyn) supplied from the system, control signal generator 44 generates polarity control signal POL, data start pulse DSP, data clock DCK, gate start pulse STV, and gate clock CPV. Control signal generator 44 also generates gate select signal Gsel based on the timing signal and the calculation result of calculator 42. Control signal generator 44 supplies polarity control signal POL, data start pulse DSP, and data clock DCK to source driver 20. Control signal generator 44 also supplies gate start pulse STV, gate clock CPV, and gate select signal Gsel to gate driver 30.

When sequentially acquiring output image data DA from image data output unit 43, source driver 20 supplies the data voltage corresponding to output image data DA to data line 11 in the acquired order based on the timing signals of data start pulse DSP and data clock DCK. Source driver 20 switches the polarity of the data voltage based on polarity control signal POL.

Based on gate start pulse STV, gate clock CPV, and gate select signal Gsel, which are input from image data output unit 43, gate driver 30 sequentially selects the plurality of gate lines 12 and supplies the gate voltage to selected gate lines 12.

Liquid crystal display device 100 having the above configuration determines the readout order of the plurality of input image data Data stored in memory 41 and the scan order of the plurality of gate lines 12 based on the input image corresponding to input image data Data. The specific method for reading input image data Data from memory 41 will be described below.

Figure 3:
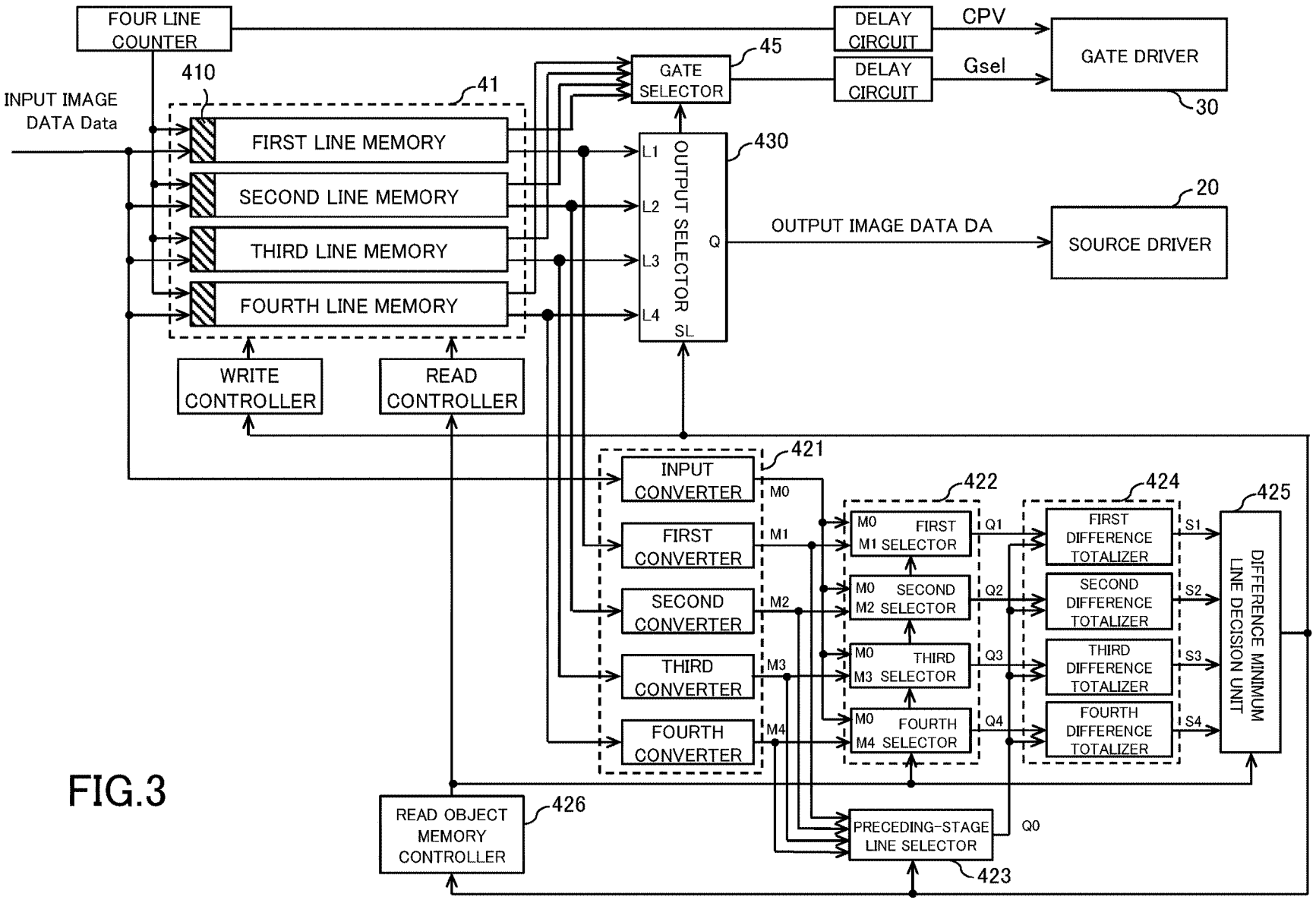
FIG. 3 is a block diagram illustrating a specific configuration of the timing controller according to the exemplary embodiment.

FIG. 3 is a block diagram illustrating a specific configuration of timing controller 40. Timing controller 40 determines the scan order such that the line in which a sum of the voltage level differences with the preceding-stage line for each pixel (a sum of the voltage level differences for each pixel of one line) is minimized becomes a line to be driven next in units of N lines (N is an integer of 2 or more) with respect to input image data Data. The voltage level difference means a difference in voltage level between two pixels connected (corresponding) to the identical data line 11. In FIG. 3, units of four lines are taken as an example. That is, memory 41 in FIG. 3 is constructed with four line memories. Timing controller 40 further includes D/V converter 421, selector 422, preceding-stage line selector 423, difference totalizer 424, difference minimum line decision unit 425, read object memory controller 426, a write controller, and a read controller, which constitute calculator 42 (see FIG. 2).

D/V converter 421 converts input image data Data of digital data into the voltage level actually applied to the liquid crystal. D/V converter 421 includes an input converter that converts the voltage level of current-line input image data Data supplied from the system, a first converter that converts the voltage level of input image data Data-L1 read from a first line memory, a second converter that converts the voltage level of input image data Data-L2 read from a second line memory, a third converter that converts the voltage level of input image data Data-L3 read from a third line memory, and a fourth converter that converts the voltage level of input image data Data-L4 read from a fourth line memory.

Selector 422 includes a first selector to which image data Data-M0 output from the input converter and image data Data-M1 output from the first converter are input, a second selector to which image data Data-M0 and image data Data-M2 output from the second converter are input, a third selector to which image data Data-M0 and image data Data-M3 output from the third converter are input, and a fourth selector to which image data Data-M0 and image data Data-M4 output from the fourth converter are input. The first selector outputs one of image data Data-M0 and image data Data-M1 as image data Data-Q1 based on a switching signal output from read object memory controller 426. The second selector outputs one of image data Data-M0 and image data Data-M2 as image data Data-Q2 based on the switching signal. The third selector outputs one of image data Data-M0 and image data Data-M3 as image data Data-Q3 based on the switching signal. The fourth selector outputs one of image data Data-M0 and image data Data-M4 as image data Data-Q4 based on the switching signal.

Preceding-stage line selector 423 selects image data Data corresponding to line memory number information output from difference minimum line decision unit 425, out of image data Data-M1 to M4, and outputs selected image data Data as image data Data-Q0 to difference totalizer 424.

Difference totalizer 424 includes a first difference totalizer to which image data Data-Q0 output from preceding-stage line selector 423 and image data Data-Q1 output from the first selector are input, a second difference totalizer to which image data Data-Q0 and image data Data-Q2 output from the second selector are input, a third difference totalizer to which image data Data-Q0 and image data Data-Q3 output from the third selector are input, and a fourth difference totalizer to which image data Data-Q0 and image data Data-Q4 output from the fourth selector are input. The first difference totalizer adds the voltage level differences between the pixels corresponding to identical data line 11 in image data Data-Q0 and image data Data-Q1 to calculate difference sum S1 for one line. The second difference totalizer adds the voltage level differences between the pixels corresponding to identical data line 11 in image data Data-Q0 and image data Data-Q2 to calculate difference sum S2 for one line. The third difference totalizer adds the voltage level differences between the pixels corresponding to identical data line 11 in image data Data-Q0 and image data Data-Q3 to calculate difference sum S3 for one line. The fourth difference totalizer adds the voltage level differences between the pixels corresponding to identical data line 11 in image data Data-Q0 and image data Data-Q4 to calculate difference sum S4 for one line.

Difference minimum line decision unit 425 determines a line memory number that minimizes a difference total value out of difference sums S1 to S4 output from difference totalizer 424, and outputs the line memory number information. The line memory number information is input to preceding-stage line selector 423, read object memory controller 426, the write controller, and output selector 430.

Based on the line memory number information, read object memory controller 426 determines the line memory that is of an object for selecting a line to be driven next (a line having the minimum sum of the voltage level differences with the preceding-stage line for each pixel). Specifically, read object memory controller 426 determines the object line memory by excluding the line memory having the line memory number indicated by the line memory number information from the read object memory of the previous line.

Information on the determined object line memory is input to the read controller, selector 422, and difference minimum line decision unit 425.

The write controller writes input image data Data in the desired line memory based on the line memory number information.

Output selector 430 reads input image data Data from the line memory having the line memory number indicated by the line memory number information, and outputs input image data Data as output image data DA to source driver 20. Image data output unit 43 includes output selector 430 (see FIG. 2).

Figure 5:
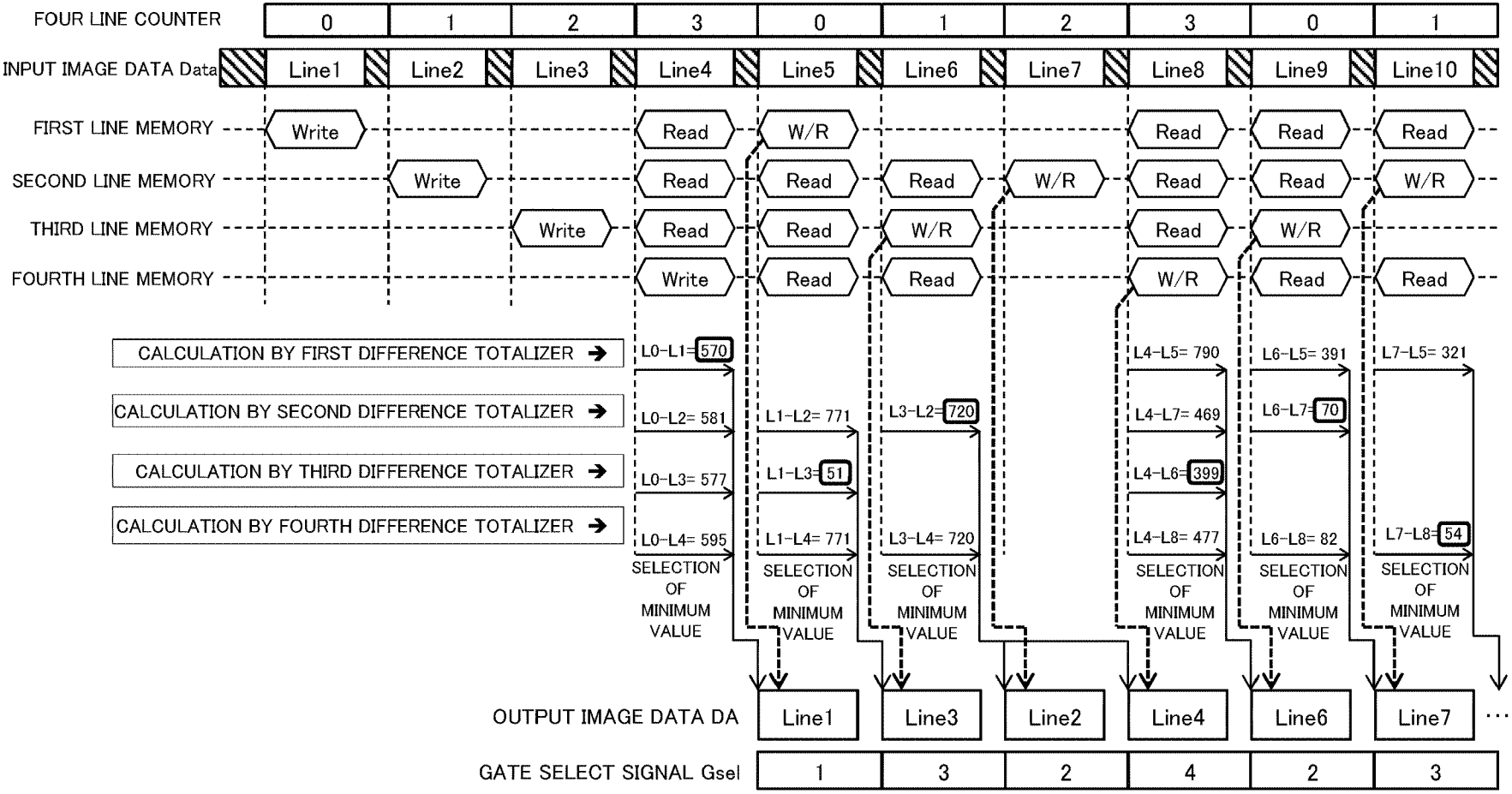
FIG. 5 is a timing chart illustrating an operation of timing controller according to the exemplary embodiment.

Operation of timing controller 40 will be described with a specific example. FIG. 4 illustrates input image data Data (digital data) and the data polarity corresponding to the column inversion drive. Schematically, timing controller 40 determines the scan order such that the line in which the sum of the voltage level differences with the preceding-stage line for each pixel is minimized becomes a line to be driven next in units of four lines with respect to input image data Data. Timing controller 40 determines first scan order by a first method, determines second scan order by a second method, and switches the first scan order and the second scan order in each plurality of frames. FIG. 5 is a timing chart illustrating the operation of timing controller 40. Line 1 indicates the image data of the first line.

The first method for determining the first scan order will be described below. First, the operation performed on input image data Data-L1 (Line 1) to Data-L4 (Line 4) of the first to fourth lines of the first frame will be described.

Figure 6:
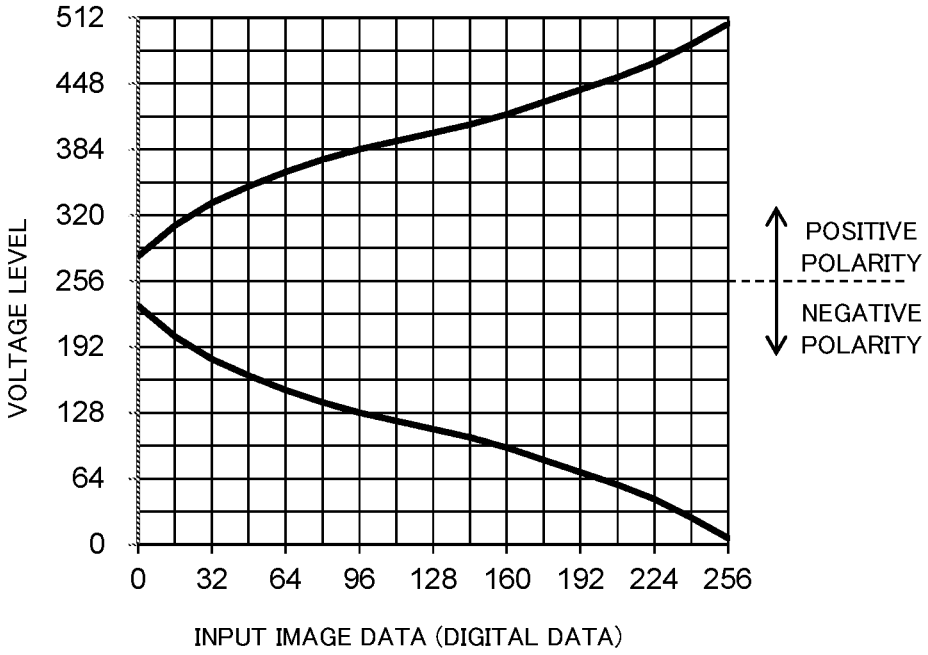
FIG. 6 is a graph illustrating a conversion characteristic of an image data of a voltage level of the input image data.

When input image data Data is input from the external system to timing controller 40, memory 41 stores input image data Data-L1 (Line 1) of the first line in the first line memory, and stores input image data Data-L2 (Line 2) of the second line in the second line memory, stores input image data Data-L3 (Line 3) of the third line in the third line memory, and stores input image data Data-L4 (Line 4) of the fourth line in the fourth line memory. Input image data Data-L4 is stored in the fourth line memory, and input to the input converter as the current-line input image data. At this point, based on the line memory number information (in this case, the first line memory, the second line memory, and the third line memory) output from read object memory controller 426, the read controller reads input image data Data-L1 to input input image data Data-L1 to the first converter, reads input image data Data-L2 to input input image data Data-L2 to the second converter, reads input image data Data-L3 to input input image data Data-L3 to the third converter, and reads input image data Data-L4 to input input image data Data-L4 to the fourth converter. Each converter of D/V converter 421 converts the voltage level of input image data Data based on, for example, a conversion characteristic in FIG. 6. FIG. 7 illustrates converted image data Data. Although the pixel data of a virtual line (Line 0) at the preceding-stage of the first line is strictly at the voltage level of the last line of the previous frame, the voltage having the different polarity is normally applied as the source voltage of the previous frame for the column inversion drive. Thus, it can be assumed that the converted voltage level is 256 for all the pixels. The input converter converts input image data Data-L4 into image data Data-M0 (Line 4), the first converter converts input image data Data-L1 into image data Data-M1 (Line 1), the second converter converts input image data Data-L2 into image data Data-M2 (Line 2), the third converter converts input image data Data-L3 into image data Data-M3 (Line 3), and the fourth converter converts input image data Data-L4 into image data Data-M4 (Line 4). In this case, image data Data-M0 and image data Data-M4 have the identical voltage level.

Then, selector 422 selects converted image data Data based on the line memory number information (the first line memory, the second line memory, and the third line memory). The first selector selects image data Data-M1 (Line 1) to output image data Data-M1 as image data Data-Q1 (Line 1), the second selector selects image data Data-M2 (Line 2) to output image data Data-M2 as image data Data-Q2 (Line 2), the third selector selects image data Data-M3 (Line 3) to output image data Data-M3 as image data Data-Q3 (Line 3), and the fourth selector selects image data Data-M0 (Line 4) to output image data Data-M0 as image data Data-Q4 (Line 4).

Preceding-stage line selector 423 outputs input image data Data of the preceding-stage line (in this case, the virtual line (Line 0)) out of image data Data-M1 to Data-M4 to difference totalizer 424 as image data Data-Q0.

Then, the first difference totalizer calculates the sum (difference sum S1=570) of the voltage level differences between the pixels corresponding to identical data line 11 in image data Data-Q0 of the preceding-stage line and image data Data-Q1 (Line 1) of the first line. The second difference totalizer calculates the sum (difference sum S2=581) of the voltage level differences between the pixels corresponding to identical data line 11 in image data Data-Q0 of the preceding-stage line and image data Data-Q2 (Line 2) of the second line. The third difference totalizer calculates the sum (difference sum S3=577) of the voltage level differences between the pixels corresponding to identical data line 11 in image data Data-Q0 of the preceding-stage line and image data Data-Q3 (Line 3) of the third line. The fourth difference totalizer calculates the sum (difference sum S4=595) of the voltage level differences between the pixels corresponding to identical data line 11 in image data Data-Q0 of the preceding-stage line and image data Data-Q4 (Line 4) of the fourth line.

Then, difference minimum line decision unit 425 determines the line memory number that minimizes the difference total value out of difference sums S1 to S4, and outputs the line memory number information. Since difference sum S1 is the minimum value (570), difference minimum line decision unit 425 outputs the line memory number information indicating the first line memory.

Then, output selector 430 reads input image data Data-L1 (Line 1) of the first line memory based on the line memory number information (first line memory), and outputs input image data Data-L1 as output image data DA to source driver 20. At the same time as reading of input image data Data-L1 (Line 1), the write controller writes input image data Data-L5 (Line 5) of the fifth line in the first line memory based on the line memory number information (first line memory) (see "W/R" of the first line memory in FIG. 5).

Then, difference minimum line decision unit 425 determines the line memory number that minimizes the difference total value out of difference sums S2 to S4 except for difference sum S1 of the minimum value, and outputs the line memory number information. Since difference sum S3 is the minimum value (51), difference minimum line decision unit 425 outputs the line memory number information indicating the third line memory. Output selector 430 reads input image data Data-L3 (Line 3) of the third line memory based on the line memory number information (third line memory), and outputs input image data Data-L3 as output image data DA to source driver 20. At the same time as the read of input image data Data-L3 (Line 3), the write controller writes input image data Data-L6 (Line 6) of the sixth line in the third line memory based on the line memory number information (third line memory) (see "W/R" of the third line memory in FIG. 5).

Then, difference minimum line decision unit 425 determines the line memory number that minimizes the difference total value (S2=720) out of difference sums S2 and S4 except for difference sums S1 and S3 of the minimum values, and outputs the line memory number information. Since difference sums S2 and S4 are equal to each other, difference sums S2 and S4 are determined according to the input order. Output selector 430 reads input image data Data-L2 (Line 2) of the second line memory based on the line memory number information (second line memory), and outputs input image data Data-L2 as output image data DA to source driver 20. At the same time as reading of input image data Data-L2 (Line 2), the write controller writes input image data Data-L7 (Line 7) of the seventh line in the second line memory based on the line memory number information (second line memory) (see "W/R" of the second line memory in FIG. 5). Finally, output selector 430 reads input image data Data-L4 (Line 4) of the fourth line memory, and outputs input image data Data-L4 as output image data DA to source driver 20.

In this manner, input image data Data-L1 to Data-L4 (Line 1 to Line 4) of the first to fourth lines of the first frame are output to source driver 20 in the order of Line 1→Line 3→Line 2→Line 4.

The operation performed on input image data Data-L5 (Line 5) to Data-L8 (Line 8) of the fifth to eighth lines of the first frame will be described below.

When input image data Data-L8 (Line 8) of the eighth line is stored in the fourth line memory subsequent to the above operation, input image data Data-L8 is simultaneously input to the input converter as input image data of the current line. At this point, based on the line memory number information (the first line memory, the second line memory, and the third line memory) output from read object memory controller 426, the read controller reads input image data Data-L5 to input input image data Data-L5 to the first converter, reads input image data Data-L6 to input input image data Data-L6 to the third converter, reads input image data Data-L7 to input input image data Data-L7 to the second converter, and reads input image data Data-L8 to input input image data Data-L8 to the fourth converter. FIG. 7 illustrates image data Data after the voltage level is converted by D/V converter 421. The input converter converts input image data Data-L8 into image data Data-M0 (Line 8), the first converter converts input image data Data-L5 into image data Data-M1 (Line 5), the second converter converts input image data Data-L7 into image data Data-M2 (Line 7), the third converter converts input image data Data-L6 into image data Data-M3 (Line 6), and the fourth converter converts input image data Data-L8 into image data Data-M4 (Line 8). In this case, image data Data-M0 and image data Data-M4 have the identical voltage level.

Then, selector 422 selects converted image data Data based on the line memory number information (the first line memory, the second line memory, and the third line memory). The first selector selects image data Data-M1 (Line 5) to output image data Data-M1 as image data Data-Q1 (Line 5), the second selector selects image data Data-M2 (Line 7) to output image data Data-M2 as image data Data-Q2 (Line 7), the third selector selects image data Data-M3 (Line 6) to output image data Data-M3 as image data Data-Q3 (Line 6), and the fourth selector selects image data Data-M0 (Line 8) to output image data Data-M0 as image data Data-Q4 (Line 8).

Preceding-stage line selector 423 selects image data Data-M4 (Line 4) corresponding to input image data Data of the preceding-stage line (in this case, the fourth line (Line 4)) out of image data Data-M1 to Data-M4 to output image data Data-M4 as image data Data-Q0 (Line 4) to difference totalizer 424.

Then, the first difference totalizer calculates the sum (difference sum S1=790) of the voltage level differences between the pixels connected to identical data line 11 in image data Data-Q0 (Line 4) of the preceding-stage line and image data Data-Q1 (Line 5) of the fifth line. The second difference totalizer calculates the sum (difference sum S2=469) of the voltage level differences between the pixels connected to identical data line 11 in image data Data-Q0 (Line 4) of the preceding-stage line and image data Data-Q2 (Line 4) of the seventh line. The third difference totalizer calculates the sum (difference sum S3=399) of the voltage level differences between the pixels connected to identical data line 11 in image data Data-Q0 (Line 4) of the preceding-stage line and image data Data-Q3 (Line 6) of the sixth line. The fourth difference totalizer calculates the sum (difference sum S4=477) of the voltage level differences between the pixels connected to identical data line 11 in image data Data-Q0 (Line 4) of the preceding-stage line and image data Data-Q4 (Line 8) of the eighth line.

Then, difference minimum line decision unit 425 determines the line memory number that minimizes the difference total value out of difference sums S1 to S4, and outputs the line memory number information. Since difference sum S3 is the minimum value (399), difference minimum line decision unit 425 outputs the line memory number information indicating the third line memory.

Then, output selector 430 reads input image data Data-L6 (Line 6) of the third line memory based on the line memory number information (third line memory), and outputs input image data Data-L6 as output image data DA to source driver 20. At the same time as reading of input image data Data-L6 (Line 6), the write controller writes input image data Data-L9 (Line 9) of the ninth line in the third line memory based on the line memory number information (third line memory) (see "W/R" of the third line memory in FIG. 5).

Then, difference minimum line decision unit 425 determines the line memory number that minimizes the difference total value out of difference sums S1, S2, S4 except for difference sum S3 of the minimum value, and outputs the line memory number information. Since difference sum S2 is the minimum value (70), difference minimum line decision unit 425 outputs the line memory number information indicating the second line memory. Output selector 430 reads input image data Data-L7 (Line 7) of the second line memory based on the line memory number information (second line memory), and outputs input image data Data-L7 as output image data DA to source driver 20. At the same time as reading of input image data Data-L7 (Line 7), the write controller writes input image data Data-L10 (Line 10) of the tenth line in the second line memory based on the line memory number information (second line memory) (see "W/R" of the second line memory in FIG. 5).

Then, difference minimum line decision unit 425 determines the line memory number that minimizes the difference total value (S4=54) out of difference sums S1 and S4 except for difference sums S2 and S3 of the minimum values, and outputs the line memory number information. Output selector 430 reads input image data Data-L8 (Line 8) of the fourth line memory based on the line memory number information (fourth line memory), and outputs input image data Data-L8 as output image data DA to source driver 20. At the same time as reading of input image data Data-L8 (Line 8), the write controller writes input image data Data-L11 (Line 11) of the eleventh line in the fourth line memory based on the line memory number information (fourth line memory). Finally, output selector 430 reads input image data Data-L5 (Line 5) of the first line memory, and outputs input image data Data-L5 as output image data DA to source driver 20.

In this manner, input image data Data-L5 to Data-L8 (Line 5 to Line 8) of the fifth to eighth lines in the first frame are output to source driver 20 in the order of Line 6→Line 7→Line 8→Line 5. In the operations performed on input image data Data-L9 (Line 9) to Data-L12 (Line 12) of the ninth to twelfth lines in the next first frame, preceding-stage line selector 423 selects image data Data-M1 (Line 5) corresponding to input image data Data of the preceding-stage line (in this case, the fifth line (Line 5)), out of input image data Data-M1 to Data-M4, and outputs image data Data-M1 as image data Data-Q0 (Line 5) to difference totalizer 424. That is, image data Data-Q0 (Line 5) of the fifth line (Line 5)) becomes the preceding-stage line. Hereafter, timing controller 40 repeatedly performs the above operation on the first frame in units of four lines. Thus, the first scan order is determined.

According to the above configuration, as illustrated in FIG. 8, after the scan order is switched, the sum of the voltage level differences for the pixels of N lines (in this case, four lines) becomes smaller than before the switching of the scan order. Thus, the drive power can be reduced. The operation in the first scan order determined by the first method is performed on a plurality of consecutive frames (for example, the first to fourth frames).

The second method for determining the second scan order will be described below. The operations performed on input image data Data-L1 (Line 1) to Data-L4 (Line 4) of the first to fourth lines of the fifth frame will be described. The second method differs from the first method in that the converted voltage level of the pixel data corresponding to the virtual line (Line 0) at the preceding stage of the first line is set to 512 and 0 as illustrated in FIG. 9. Specifically, in the column inversion drive, the voltage level of a column of the positive polarity (+) in virtual line Line 0 is set to a high gradation (for example, 512), and the voltage level of a column of the negative polarity (−) in virtual line Line 0 is set to the low gradation (for example, zero). When the voltage level of virtual line Line 0 is set to a center level (halftone; for example, 256) (first method), the line closer to a black level is selected in order (in the ascending order of the gradation of input image data Data). On the other hand, when the voltage level of the column of the positive polarity (+) in virtual line Line 0 is set to 512 and the voltage level of the column of the negative polarity (−) in virtual line Line 0 is set to zero (the second method), the line closer to a white level is selected in order (in the descending order of the gradation of input image data Data). The gradation of input image data Data means the sum of the gradations of the pixels corresponding to the image signal (input image data Data) (for one line) input in one horizontal scan period. As illustrated in FIG. 10B, the scan order can substantially be reversed with respect to the scan order by the first method (first scan order) (FIG. 8B). That is, in the above example, in the first frame (first scan order), the order is Line 1→Line 3→Line 2→Line 4→Line 6→Line 7→Line 8→Line 5 (see FIG. 8B), in the fifth frame (second scan order), the order is Line 4→Line 2→Line 3→Line 1→Line 5→Line 8→Line 7→Line 6 (see FIG. 10B). In this manner, the scan order is reversed. The operation in the second scan order determined by the second method is performed on a plurality of consecutive frames (for example, the fifth to eighth frames). The operation in the first scan order determined by the first method is performed on the subsequent ninth to twelfth frames. In this manner, the first virtual line data in which the voltage level of each pixel is set to the voltage level of halftone ("256" in the above example) is used as the line data of the preceding-stage line in determining the line to be scanned first out of the first N lines (in this case, four lines) of each frame when the first scan order is determined, and the second virtual line data in which the voltage level of each pixel is set to the voltage level of the low gradation or the high gradation ("512", "0" in the above example) is used as the line data of the preceding-stage line in determining the line to be scanned first out of the first N lines of each frame when the second scan order is determined.

Figure 19:
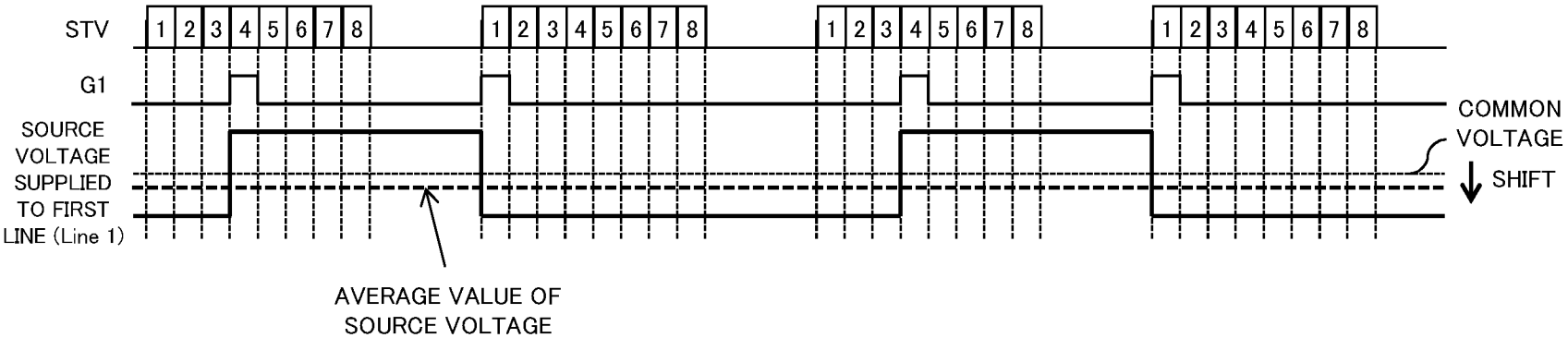
FIG. 19 is a timing chart illustrating a scan order of a conventional display device.

Timing controller 40 switches the first scan order determined by the first method and the second scan order determined by the second method for each plurality of frames. Consequently, the average value of the source voltage is prevented from shifting from the common voltage (see FIG. 19), so that the burning on the display screen can be reduced. When the polarity is inverted every odd-numbered frame (for example, for one-frame inversion drive), timing controller 40 preferably switches the first scan order and the second scan order for each even-numbered frame. Similarly, when the polarity is inverted every even-numbered frame (for example, for two-frame inversion drive), timing controller 40 preferably switches the first scan order and the second scan order for each odd-numbered frame. Consequently, the average value of the source voltage can be brought closer to the common voltage.

The method for reversing the scan order is not limited to the above method. For example, the head line to be driven first in each frame may be determined as the first line or the fourth line, and the scan order for every N lines may be determined by switching the head line between the first line and the fourth line in each plurality of frames.

Figure 11:
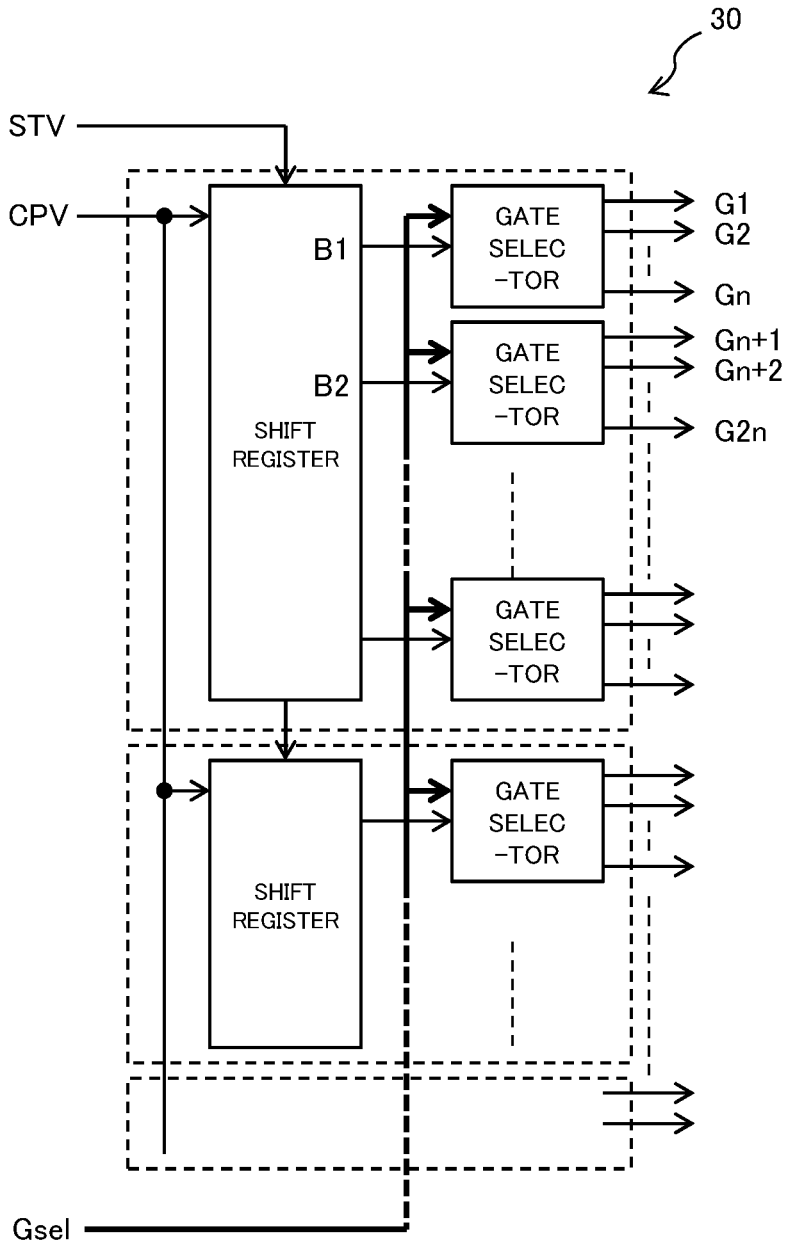
FIG. 11 is a block diagram illustrating a specific configuration of a gate driver according to the exemplary embodiment.

A specific configuration of gate driver 30 will be described below. FIG. 11 is a block diagram illustrating the specific configuration of gate driver 30. Gate driver 30 includes a plurality of gate selectors and a plurality of shift registers. N gate lines 12 are electrically connected to each gate selector. The plurality of gate selectors are connected to each shift register. Gate start pulse STV and gate clock CPV output from timing controller 40 are input to the first-stage shift register. The shift clock output from the preceding-stage shift register and gate clock CPV output from timing controller 40 are input to the shift registers at the second and subsequent stages. Each shift register sequentially selects the gate selector based on gate clock CPV. Gate select signal Gsel output from timing controller 40 is input to the gate selector.

Figure 12:
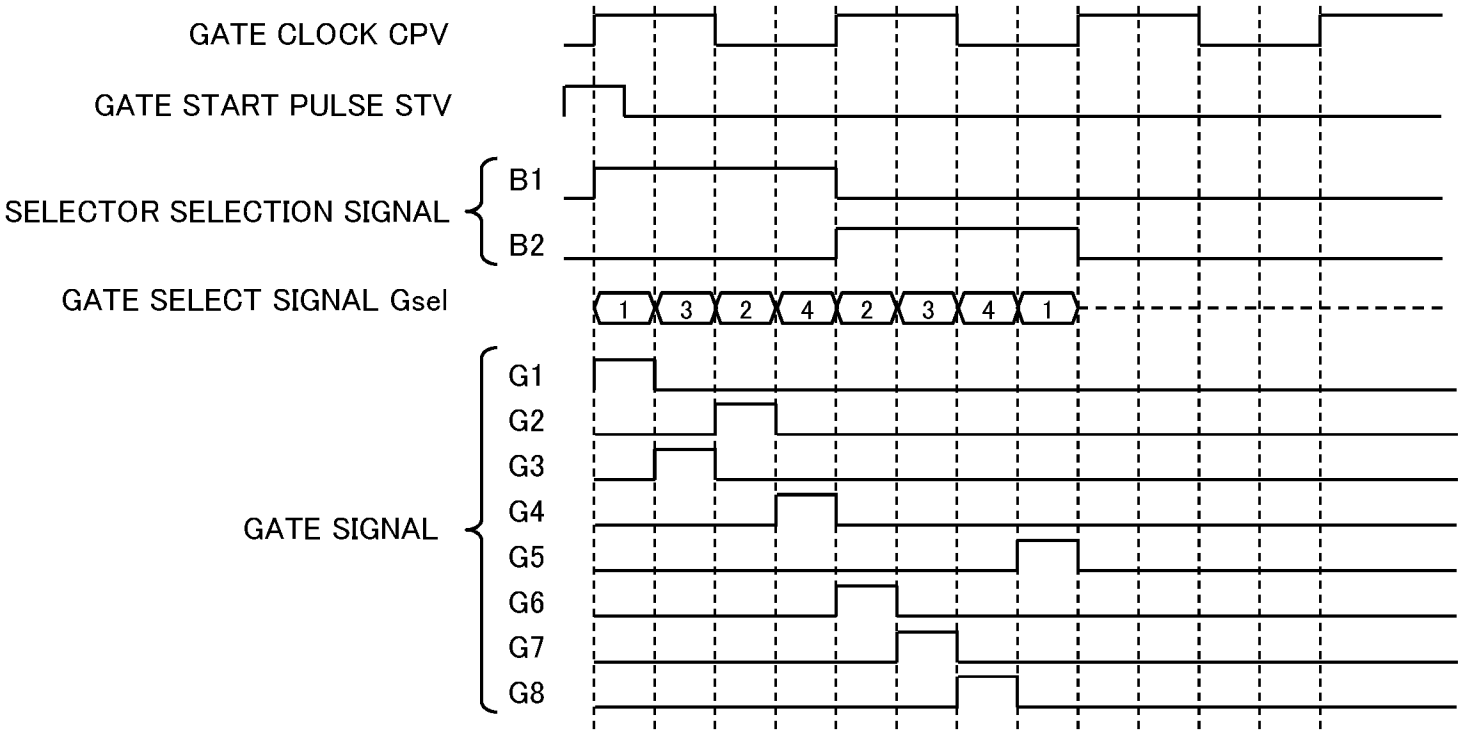
FIG. 12 is a timing chart illustrating an operation of the gate driver according to the exemplary embodiment.

FIG. 12 is a timing chart illustrating the operation of gate driver 30. In FIG. 12, the case (n=4) that four gate lines are connected to one gate selector is exemplified according to the above example (FIG. 5 and the like). As illustrated in FIG. 12, the gate selectors of the first to fourth lines are selected by selector selection signal B1, and gate line 12 is selected in the order of first line G1→third line G3→second line G2→fourth line G4 according to gate select signal Gsel. Subsequently, the gate selectors of the fifth to eighth lines are selected by selector selection signal B2, and gate line 12 is selected in the order of sixth line G6→seventh line G7→eighth line G8→fifth line G5 according to gate select signal Gsel. Gate driver 30 is not limited to the above configuration, but a known configuration can be adopted.

Figure 13:
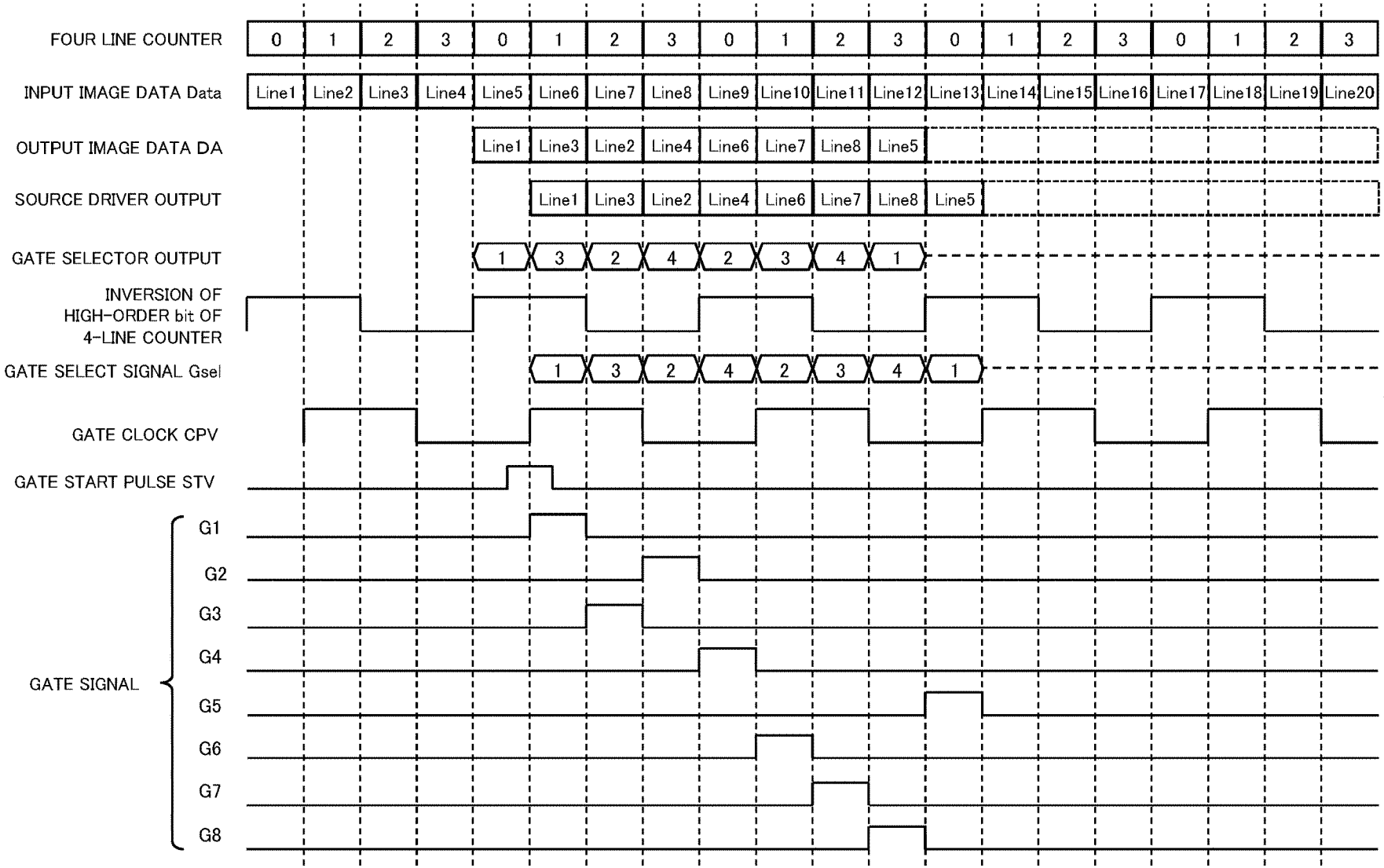
FIG. 13 is a timing chart illustrating the output timing of the liquid crystal display device according to the exemplary embodiment.

Output timing of timing controller 40, source driver 20, and gate driver 30 will be described below. FIG. 13 is a timing chart illustrating the output timing of liquid crystal display device 100.

A 4-line counter is reset at the beginning of every four lines of input image data Data, and circulates around counter values 0 to 3. The timing of writing input image data Data in the line memory is set identical to the timing of switching the counter value of the 4-line counter. Counter value holding unit 410 (see FIG. 3) is provided in each line memory of memory 41, and gate select information (counter value) is added to the head of input image data Data when input image data Data is written in the line memory. Gate clock CPV is generated by inverting a high-order bit of the 4-line counter. Since output image data DA is delayed by 1H in source driver 20, a 1H delay circuit (see FIG. 3) is provided at the subsequent stage of the 4-line counter in order to adjust the timing of gate clock CPV. The output timing of gate selector 45 is set identical to the output timing of output selector 430. Consequently, the output timing of source driver 20 is set identical to the output timing of gate select signal Gsel, and the source voltage is supplied to the pixels of a predetermined line. The 4-line counter, gate selector 45, and the delay circuit in FIG. 3 are included in control signal generator 44 (see FIG. 2).

With the above configuration, liquid crystal display device 100 determines the readout order of the plurality of input image data Data stored in memory 41 and the scan order of the plurality of gate lines 12 based on the input image corresponding to input image data Data, and displays the image.

Although the column inversion drive is taken as an example in the above configuration, liquid crystal display device 100 is not limited to the column inversion drive, but liquid crystal display device 100 may perform the display operation by the dot inversion drive. For dot inversion drive (FIG. 14B), D/V converter 421 converts input image data Data (see FIG. 4A) into the voltage level in FIG. 14A. Other operations are identical to those of liquid crystal display device 100. The sums of voltage level differences with the preceding-stage line for each pixel are compared in the above configuration. However, liquid crystal display device 100 is not limited to the comparison of the sums of voltage level differences, but the sums of power differences with the preceding-stage line for each pixel may be compared. In this case, for example, the sum of the squares of the voltage level differences with the preceding-stage line for each pixel may be obtained and compared.

Figure 15:
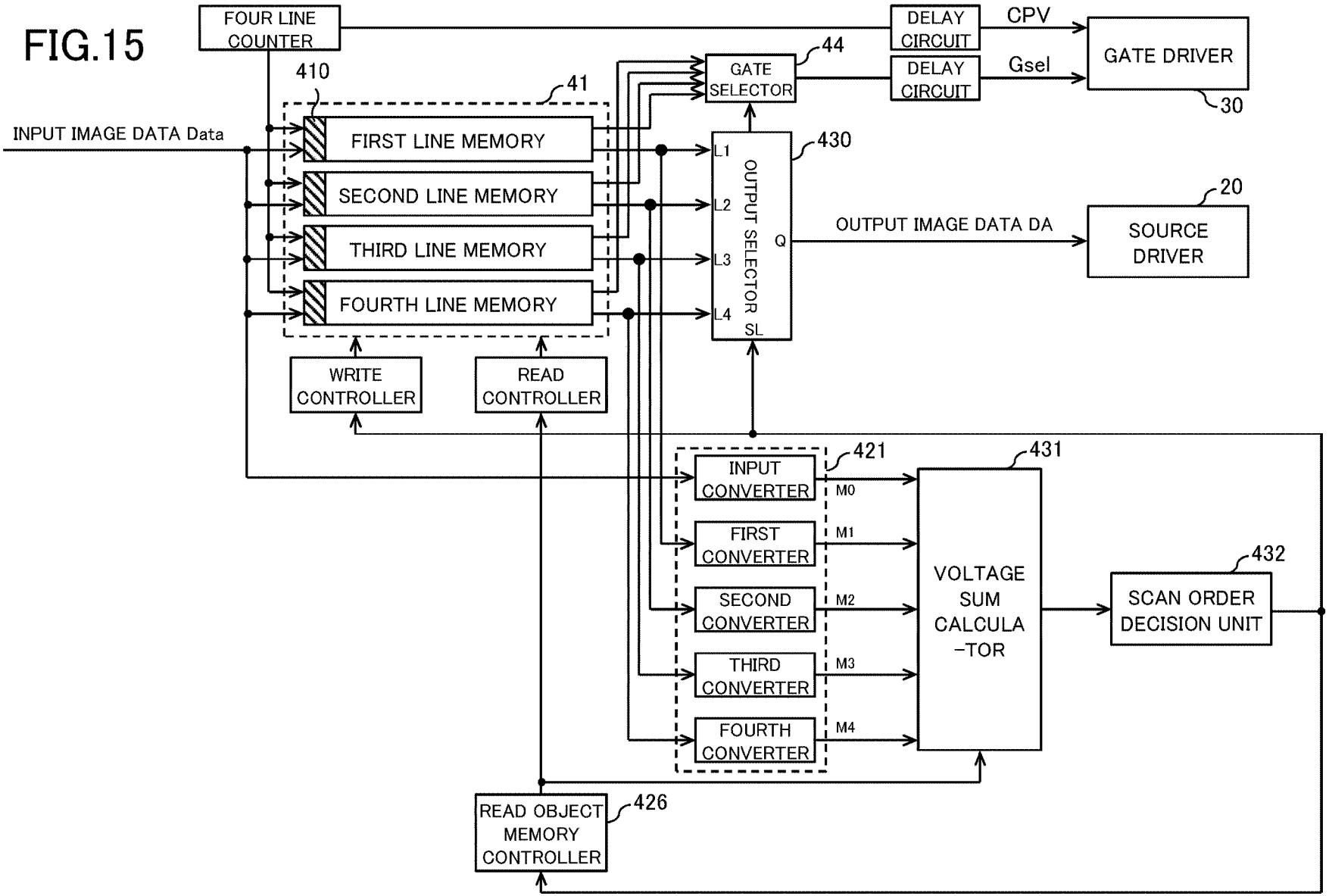
FIG. 15 is a block diagram illustrating a specific configuration of the timing controller according to the exemplary embodiment.

The method for determining the scan order of the plurality of gate lines 12 is not limited to the above method. For example, in units of N lines, the sum of the voltage level differences between the pixels connected to identical data line 11 is calculated between two adjacent lines, and the scan order in which the sum is minimized among all combinations of the scan order may be determined. FIG. 15 is a block diagram illustrating a specific configuration of timing controller 40 for performing this method. The block diagram in FIG. 15 differs from the block diagram in FIG. 3 in voltage sum calculator 431 and scan order decision unit 432, and other configurations are identical. The voltage sum calculator 431 calculates the sum of the voltage level differences between the pixels connected to identical data line 11 between two adjacent lines, and calculates the sum of the voltage level differences among all the combinations of the scan order. The scan order decision unit 432 determines the scan order of gate lines 12 based on the calculation result of voltage sum calculator 431.

Figure 17:
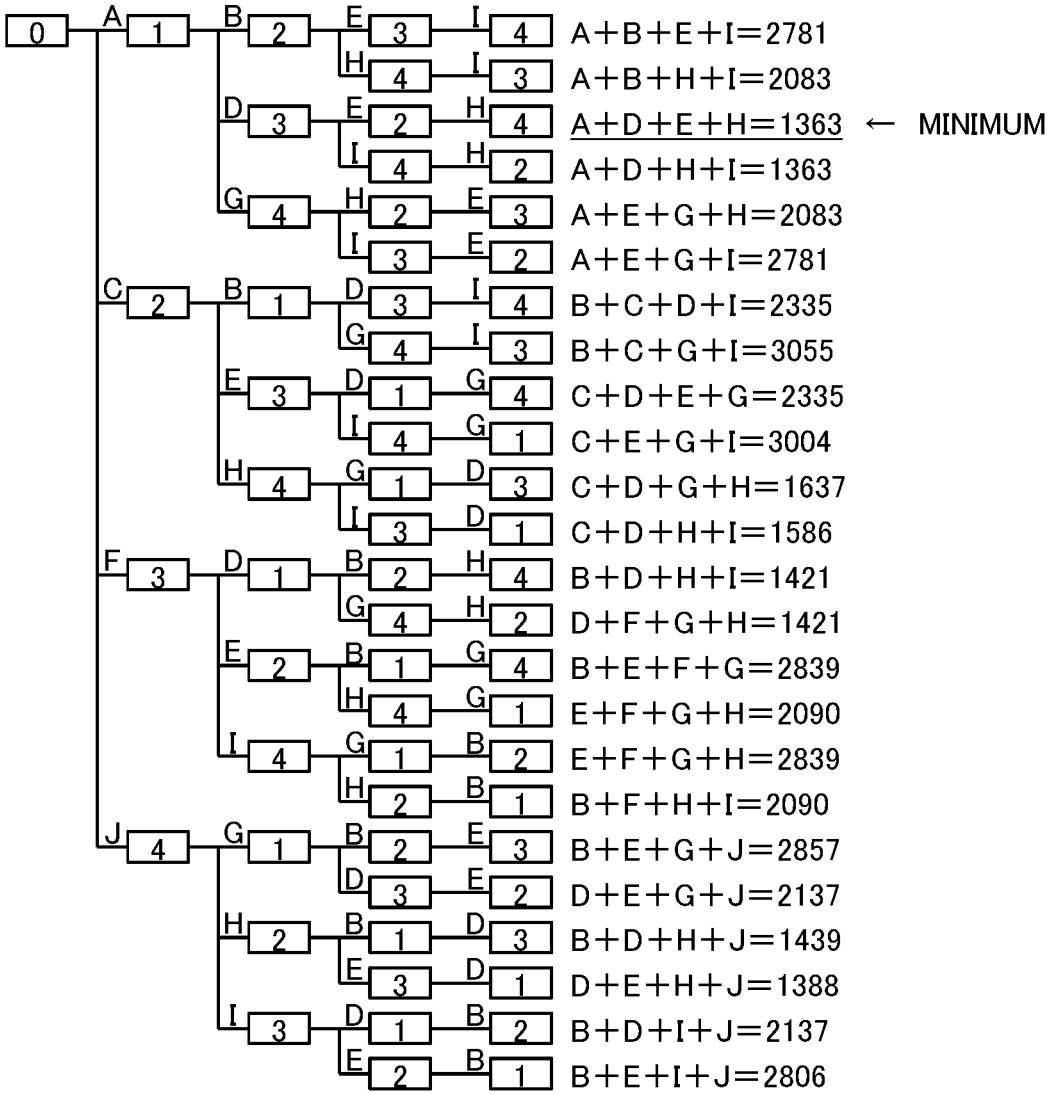
FIG. 17 illustrates all combinations of a scan order in units of four lines and a calculation example of the sum of the voltage level differences in each scan order.
Figure 18A:
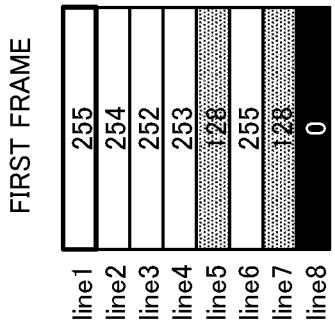
FIGS. 18A-18H are schematic diagrams illustrating a generation principle of a DC burning.
Figure 18B:
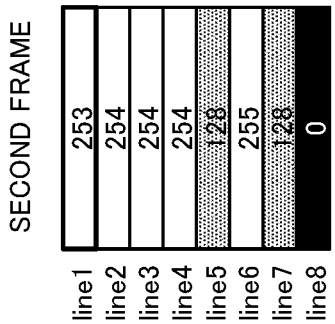
Figure 18C:
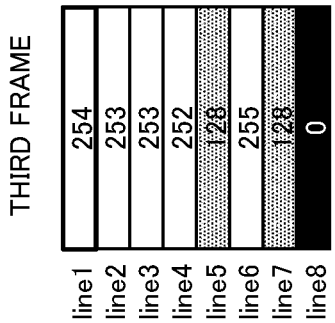
Figure 18D:
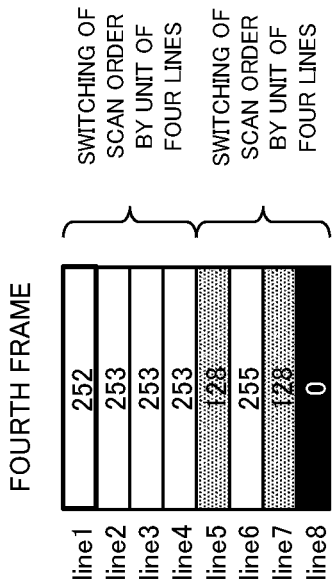
Figure 18E:
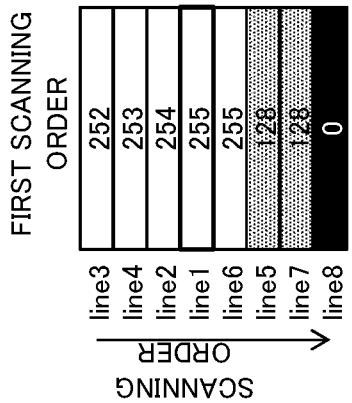
Figure 18F:
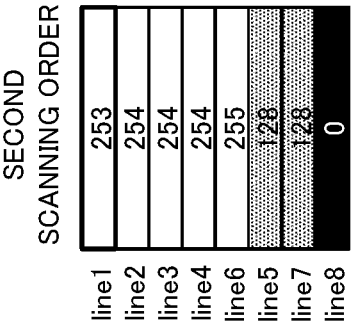
Figure 18G:
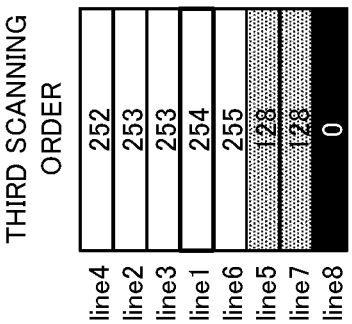
Figure 18H:
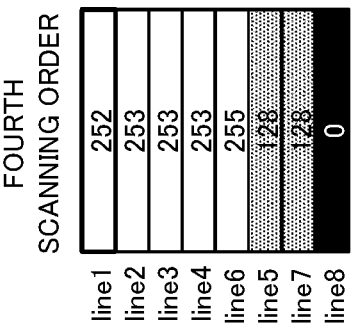

FIG. 16 illustrates a calculation example of the voltage level difference between two lines for units of four lines. FIG. 17 illustrates all the combinations of the scan order in units of four lines and a calculation example of the sum of the voltage level differences in each scan order. According to the examples in FIGS. 16 and 17, the first scan order becomes the combination in which the sum of the voltage level differences is minimized (A+D+E+H=1363), that is, the order of Line 1→Line 3→Line 2→Line 4. As illustrated in FIG. 9, the second scan order is determined in the manner similar to the examples in FIGS. 16 and 17 after the converted voltage level of the pixel data corresponding to the virtual line (Line 0) at the preceding stage of the first line is set to 512 and 0 (second method). Liquid crystal display device 100 scans gate line 12 by switching the first scan order and the second scan order, which are determined in this manner in each plurality of frames.

The method for determining the scan order of the plurality of gate lines 12 may be the following method. For example, in units of N lines, the scan order may be determined such that the scanning is performed in the ascending order (or the descending order) of the total value of the voltage levels of each line (the digital data value or the gradation of input image data Data). Specifically, among the blocks constructed in units of N lines, the odd-numbered block is scanned in the ascending order of the voltage level (first scanning order), and the even-numbered block is scanned in the descending order of the voltage level (second scan order). Then, for each plurality of frames, the first scan order and the second scan order are switched.

In the above method, memory 41 may be constructed with a frame memory. In this case, timing controller 40 determines the scan order in units of frames. For example, timing controller 40 performs the scanning in the first scan order (for example, in the ascending order of the frame with respect to the voltage level (or gradation) in four frames) determined by the first method in the first to fourth frames, and timing controller 40 performs the scanning in the second scan order (for example, in the descending order of the frame with respect to the voltage level (or gradation) in four frames) determined by the second method in the fifth to eighth frames. In this case, the gradation of input image data Data means the sum of the gradations of the pixels corresponding to the image signal (input image data Data) (for one frame) input in one vertical scan period.

While there have been described what are at present considered to be certain embodiments of the application, it will be understood that various modifications may be made thereto, and it is intended that the appended claims cover all such modifications as fall within the true spirit and scope of the invention.

What is claimed is:

1. A display device comprising:

a plurality of data lines extending in a first direction;

a plurality of gate lines extending in a second direction;

a source driver that supplies a data signal to the plurality of data lines;

a gate driver that supplies a gate signal to the plurality of gate lines; and a timing controller that determines scan order of the plurality of gate lines and outputs image data to the source driver based on the scan order, wherein the timing controller determines the scan order of the plurality of gate lines based on an input image corresponding to input image data input from outside, and switches first scan order and second scan order in each plurality of frames, the first scan order and the second scan order being different from each other in the scan order, the timing controller determines the scan order in units of N lines (N being an integer of 2 or more), in first line data corresponding to a preceding-stage line and a plurality of second line data corresponding to a plurality of lines included in the N lines in the input image data, the timing controller determines the scan order based on a voltage level difference between pixels corresponding to the identical data line in each of the first line data and the second line data, when the first scan order is determined, first virtual line data in which a voltage level of each pixel is set to a voltage level of halftone is used as the first line data in determining a line to be scanned first out of first N lines in each frame, and when the second scan order is determined, second virtual line data in which the voltage level of each pixel is set to a voltage level of a low gradation or a high gradation in determining the line to be scanned first out of the first N lines in each frame.

2. The display device according to claim 1, wherein the first scan order is ascending order of a gradation of the input image data, and the second scan order is descending order of the gradation of the input image data.

3. The display device according to claim 1, wherein the timing controller determines a line having a minimum sum of voltage level differences in the plurality of lines as a line to be scanned next.

4. The display device according to claim 1, wherein the timing controller includes a plurality of line memories that store the input image data for each line, and the timing controller sequentially reads the input image data from the plurality of line memories according to the scan order, and outputs the input image data to the source driver.

5. A method for driving a display device including:

a plurality of data lines extending in a first direction;

a plurality of gate lines extending in a second direction;

a source driver that supplies a data signal to the plurality of data lines;

a gate driver that supplies a gate signal to the plurality of gate lines; and a timing controller that determines scan order of the plurality of gate lines and outputs image data to the source driver based on the scan order, the method comprising:

determining the scan order of the plurality of gate lines based on an input image corresponding to input image data input from outside; and scanning the plurality of gate lines by switching first scan order and second scan order in each plurality of frames, the first scan order and the second scan order being different from each other in the scan order, wherein the timing controller determines the scan order in units of N lines (N being an integer of 2 or more), in first line data corresponding to a preceding-stage line and a plurality of second line data corresponding to a plurality of lines included in the N lines in the input image data, the timing controller determines the scan order based on a voltage level difference between pixels corresponding to the identical data line in each of the first line data and the second line data, when the first scan order is determined, first virtual line data in which a voltage level of each pixel is set to a voltage level of halftone is used as the first line data in determining a line to be scanned first out of first N lines in each frame, and when the second scan order is determined, second virtual line data in which the voltage level of each pixel is set to a voltage level of a low gradation or a high gradation in determining the line to be scanned first out of the first N lines in each frame.

* * * * *